US010457461B2

(12) United States Patent
Dincer et al.

(10) Patent No.: US 10,457,461 B2
(45) Date of Patent: Oct. 29, 2019

(54) CONTAINER WITH INNER PACKAGE

(71) Applicant: PHILIP MORRIS PRODUCTS S.A., Neuchatel (CH)

(72) Inventors: Ahmet Dincer, Le Mont-sur-Lausanne (CH); Bodo-Werner Lutzig, Chavornay (CH); Sergey Ledermann, Neuchâtel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/769,481

(22) PCT Filed: Oct. 19, 2016

(86) PCT No.: PCT/IB2016/056287
§ 371 (c)(1),
(2) Date: Apr. 19, 2018

(87) PCT Pub. No.: WO2017/072630
PCT Pub. Date: May 4, 2017

(65) Prior Publication Data

US 2018/0305101 A1 Oct. 25, 2018

(30) Foreign Application Priority Data

Oct. 26, 2015 (EP) ..... 15191480

(51) Int. Cl.
*B65D 85/10* (2006.01)
*B65D 77/04* (2006.01)
(Continued)

(52) U.S. Cl.
CPC ..... *B65D 77/04* (2013.01); *B65D 5/54* (2013.01); *B65D 75/5833* (2013.01);
(Continued)

(58) Field of Classification Search
CPC ..... B65D 5/54; B65D 65/14; B65D 75/5833; B65D 75/5838; B65D 77/02; B65D 77/04; B65D 85/1018; B65D 85/1045
(Continued)

(56) References Cited

U.S. PATENT DOCUMENTS 8,365,978 B2 * 2/2013 Yoshimura ..... B65D 5/5425 206/264
2009/0321437 A1 * 12/2009 Polloni ..... B65D 5/5035 220/23.9

(Continued)

FOREIGN PATENT DOCUMENTS

EP 2281759 A1 2/2011
EP 2455302 A1 5/2012

(Continued)

OTHER PUBLICATIONS

Extend European Search Report issued by the European Patent Office for corresponding application No. EP 15191480.1, dated Feb. 5, 2016; 7 pgs.

(Continued)

*Primary Examiner* — Luan K Bui
(74) *Attorney, Agent, or Firm* — Mueting, Raasch & Gebhardt, P.A.

(57) ABSTRACT

A container includes an inner package (130) disposed within a housing (112). The inner package includes a wrapper having a line of weakness (142) that defines a flap (144) in the wrapper. The flap is attached to an inner surface (122) of a lid of the container such that upon opening the lid the flap is separated from the wrapper along the line of weakness (142) and hinged to the remainder of the wrapper along a flap hinge line to form an access opening (160) through which the consumer goods can be removed.

20 Claims, 4 Drawing Sheets

(51) Int. Cl.
*B65D 75/58* (2006.01)
*B65D 77/02* (2006.01)
*B65D 5/54* (2006.01)

(52) U.S. Cl.
CPC ..... *B65D 75/5838* (2013.01); *B65D 77/02* (2013.01); *B65D 85/1045* (2013.01)

(58) Field of Classification Search
USPC ..... 206/245, 265, 268, 271, 273; 229/87.14, 229/160.1
See application file for complete search history.

(56) References Cited

U.S. PATENT DOCUMENTS

2010/0230303 A1* 9/2010 Buse ..... B65D 5/38 206/268
2010/0252462 A1* 10/2010 Marchetti ..... B65D 5/606 206/268
2011/0114518 A1* 5/2011 Hein ..... B65B 19/20 206/268
2012/0111746 A1* 5/2012 Tanbo ..... B65D 77/02 206/268
2014/0110286 A1* 4/2014 Bertuzzi ..... B65D 75/5894 206/268
2014/0374290 A1* 12/2014 Seyfferth De Oliveira ..... B65D 85/1045 206/268
2015/0021219 A1* 1/2015 Seyfferth De Oliveira ..... B65D 85/1045 206/268
2015/0034509 A1* 2/2015 Seyfferth De Oliveira ..... B65D 85/1045 206/268
2017/0203910 A1 7/2017 Buse et al.

FOREIGN PATENT DOCUMENTS

JP 2001/301745 A 10/2001
WO WO 2012/147073 A1 11/2012
WO WO 2014/082717 A1 6/2014
WO WO 2015/011621 A1 1/2015
WO WO 2016/020032 A1 2/2016
WO WO 2016/087819 A1 6/2016
WO WO 2017/002001 A1 1/2017

OTHER PUBLICATIONS

International Search Report and Written Opinion, issued by the European Patent Office for corresponding application No. PCT/IB2016/056287, dated Dec. 5, 2016; 12 pgs.
International Preliminary Report on Patentability, issued by the European Patent Office for corresponding application No. PCT/IB2016/056287, dated Oct. 16, 2017; 6 pgs.
Third Party Observation, issued by the International Bureau of WIPO, dated Feb. 9, 2018, for PCT/IB2016/056287; 10 pgs.

* cited by examiner

CONTAINER WITH INNER PACKAGE

This application is the § 371 U.S. National Stage of International Application No. PCT/IB2016/056287, filed 19 Oct. 2016, which claims the benefit of EP Patent Application No. 15191480.1, filed 26 Oct. 2015. The disclosures of these applications are incorporated by reference herein in their entireties.

The present invention relates to a container for consumer goods with an inner package. The container finds particular application as a container for elongate smoking articles such as cigarettes.

Smoking articles such as cigarettes and cigars are commonly packaged in rigid hinge-lid containers having a box and a lid connected to the box about a hinge line extending across the rear wall of the container. Such hinge-lid containers are typically constructed from one-piece laminar cardboard blanks. In use, the lid is pivoted about the hinge line to open the container and so gain access to a bundle of smoking articles disposed within the box.

The bundle of smoking articles disposed within the box is typically wrapped in an inner liner of metalized paper, metal foil, or other flexible sheet material. To access the bundle of smoking articles within the inner liner of an unopened container, a consumer typically has to first open the lid of the container, remove a pre-perforated upper portion or pull tab of the inner liner, and then discard the pull tab.

One object of the invention is to provide a container for consumer goods that simplifies opening of the container. Other objects of the present invention will be evident to those of skill in the art upon reading and understanding the present disclosure, which includes the claims that follow and the accompanying drawings.

In one aspect of the present invention, a container for consumer goods is described. The container includes a housing including a box and a lid hingedly attached to the box, where the box includes a front wall and a rear wall. The container also includes an inner package disposed within the housing and at least partially defining an interior volume for housing consumer goods. The inner package includes a line of weakness that defines a flap. The flap is attached to an inner surface of the lid such that upon opening the lid the flap is separated from the inner package along the line of weakness to form an access opening through which the consumer goods can be removed.

According to a first aspect of the present invention, there is provided a container for consumer goods, comprising: a housing comprising a box and a lid hingedly attached to the box along a lid hinge line, the box comprising a front wall and a rear wall. The lid is adapted to be manipulated between an open position and a closed position. An inner package is disposed within the housing and at least partially defines an interior volume for housing consumer goods. The inner package comprises a wrapper comprising a line of weakness that defines a flap in the wrapper. The flap is attached to an inner surface of the lid such that upon opening the lid the flap is separated from the wrapper along the line of weakness and hinged to the remainder of the wrapper along a flap hinge line to form an access opening through which the consumer goods can be removed. The flap hinge line is spaced from the lid hinge line. The entire inner surface of the flap is provided by the inner surface of the wrapper.

Various aspects of the present invention may have one or more advantages relative to currently-available or previously-described containers. For example, the consumer goods disposed within the container can be accessed by a consumer by opening the lid of the container. The consumer is not, therefore, required to both open the lid and remove the pull tab. Further, the consumer does not need to dispose of the pull tab after opening the inner package as the flap, which replaces the pull tab, remains attached to the lid.

The consumer goods within the container may be wrapped in a wrapper, sometimes referred to as an inner liner. The inner liner and consumer goods together form an inner package. The container can also include an inner frame disposed either within the inner package or between the inner package and the box of the housing. Prior to first opening, the filled container may be wrapped in an outer wrapper.

Disposed within the housing is an inner package that includes the consumer goods. The inner package at least partially defines an interior volume for housing consumer goods. The inner package includes a wrapper. The wrapper can include an inner surface and an outer surface. The inner surface is the surface of the wrapper that predominantly faces towards the interior of the container, for example towards the consumer goods. The outer surface is the surface of the wrapper that predominantly faces towards the exterior of the container. The inner package can also include a line of weakness formed in the wrapper that defines a flap in the wrapper. The line of weakness can take any suitable shape or combination of shapes. Preferably, the line of weakness defines a flap that has three sides that separate the flap from the wrapper, and a fourth side that forms a flap hinge line between the flap and the remainder of the wrapper. In one or more embodiments, the flap can be attached to an inner surface of the lid of the box such that upon opening the lid the flap is separated from the inner package along the line of weakness to form the access opening through which the consumer goods can be removed. The flap can take any suitable shape or combination of shapes and have any suitable dimensions.

The line of weakness can be continuous or discontinuous (for example, perforated). Further, the line of weakness can be formed using any suitable technique or combination of techniques, for example, laser cutting or mechanical cutting (for example, die cutting or kiss cutting). The line of weakness can include any suitable depth in a direction transverse to the inner and outer surfaces of the wrapper. Preferably, the line of weakness has a depth that is at least about 90 percent of a total thickness of the wrapper. More preferably, the line of weakness has a depth that is about 100 percent of the total thickness of the wrapper. Any suitable percentage of material can remain along the line of weakness after the line has been formed. Preferably, between about 5 percent and about 25 percent of material of the wrapper remains along the line of weakness after the line has been formed.

The inner package may be more securely sealed along the line of weakness before the first opening of the container. This may increase the storage life of the consumer goods contained within the container.

The access opening can be disposed in any suitable location on the wrapper. In one or more embodiments, the access opening can be disposed on the wrapper such that it is located on a front wall of the inner package. In one or more embodiments, the access opening can be disposed on the wrapper such that it is located on a top wall of the inner package. In one or more embodiments, the access opening can be disposed on the wrapper such that it is located across a portion of the front wall and the top wall of the inner package.

The access opening can take any suitable shape or combination of shapes. Further, the access opening can be formed using any suitable technique or combination of techniques, for example, laser cutting or mechanical cutting (for example, die cutting).

The wrapper can include any suitable material or combination of materials and can include any suitable number of layers. Preferably, the wrapper is formed of metal foil or metalized paper. The wrapper may be formed as a laminate of a metalized polyethylene film and a liner material. In one or more embodiments, the wrapper includes a paper material. In one or more embodiments, the wrapper includes one or more paper layers and one or more additional layers of material, including one or more metallic, polymeric, and inorganic materials. The wrapper can have a thickness that is between about 10 microns and about 50 microns and preferably about 20 microns to about 80 microns. In addition, the wrapper may be provided with a print-receptive top coating.

At least a portion of the outer surface of the wrapper can be permanently affixed to a corresponding portion of an inner surface of the rear wall of the box. Any suitable technique or combination of techniques can be utilized to affix this portion of the outer surface of the wrapper to the rear wall of the box. Preferably, a permanent adhesive is utilized to attach the portion of the outer surface of the wrapper to the rear wall of the box. Further, at least a portion of the outer surface of the wrapper can be permanently affixed to a corresponding portion of an inner surface of the front wall of the box. Once again, any suitable technique or combination of techniques can be utilized to attach this portion of the outer surface of the wrapper to the inner surface of the front wall of the box, for example, adhering the outer surface of the wrapper to the inner surface of the front wall of the box with a permanent adhesive.

In one or more embodiments, the flap of the inner package defined by the line of weakness can be attached to an inner surface of the lid of the housing of the container. Any suitable technique or combination of techniques can be utilized to attach the flap to the inner surface of the lid, for example, mechanical fasteners, adhesives, thermal or ultrasonic bonds, and combinations thereof. Preferably, the flap is attached to the inner surface of the lid using an adhesive. The adhesive can be any suitable adhesive or combination of adhesives. Preferably, the adhesive is a permanent adhesive. Any suitable portion of the flap can be attached to the inner surface of the lid. In one or more embodiments, a portion of the outer surface of the flap is attached to the inner surface of the lid. In one or more embodiments, a portion of the inner surface of the flap is attached to the lid. In one or more embodiments, the flap can be attached to an inner lid front wall. As used herein, the term "inner lid front wall" means an inner surface of the front wall of the lid. In one or more embodiments, the flap is only attached to the inner lid front wall, thereby creating a gap between an inner surface of the top wall and rear wall and the flap.

When the lid is in an open position, the flap can take any suitable shape or combination of shapes. In one or more embodiments, the flap forms an S-shape when the lid is in the open position. The S-shape formed by the flap can provide various advantages. For example, an S-shaped flap can more easily snap shut when the lid is moved to a closed position, thereby providing a better seal between the flap and the inner package. Further, an S-shaped flap can provide a more continuous peeling of the flap from the inner package when the lid is moved from the closed position to the open position.

The inner package comprises a wrapper that can be folded in any suitable manner to provide the desired shape. In one or more embodiments, the inner package can be formed such that it includes an envelope fold in the wrapper disposed in any suitable location, for example, on at least one of the top wall, bottom wall, front wall, rear wall, and sidewalls of the inner package. The envelope fold can be formed using any suitable technique or combination of techniques and can be any suitable type of envelope fold. In one or more embodiments, the envelope fold can include one or more tabs that are folded over the inner package. The inner package can be formed to include other types of folds, for example, one or more fin folds.

In one or more embodiments, the wrapper of the inner package can be folded along one or more fold lines to form the inner package where the wrapper includes a first edge and a second edge. The wrapper can be folded such that at least a portion of each of the first and second edges of the wrapper transversely overlap a front wall of the inner package. In one or more embodiments, the flap of the wrapper can include at least a portion of at least one of the first edge of the wrapper and the second edge of the wrapper that is disposed on the front wall of the inner package. Further, in one or more embodiments, at least one of the first and second edges can be folded over upon itself such that an inner surface of the flap that includes the portion of one or both of the first and second edges can be attached to the inner surface of the lid.

According to a second aspect of the present invention, there is provided a container for consumer goods, comprising: a housing comprising a box and a lid hingedly attached to the box, wherein the box comprises a front wall and a rear wall. An inner package is disposed within the housing and at least partially defines an interior volume for housing consumer goods. The inner package comprises a line of weakness that defines a flap. The flap is attached to an inner surface of the lid such that upon opening the lid the flap is separated from the inner package along the line of weakness to form an access opening through which the consumer goods can be removed. The inner package comprises a wrapper that is folded along one or more fold lines to form the inner package. The wrapper comprises a first edge and a second edge. The wrapper is folded such that at least a portion of each of the first and second edges of the wrapper transversely overlaps a front wall of the inner package. The flap comprises at least a portion of the first edge of the wrapper that is disposed on the front wall of the inner package.

The container may take any suitable form for housing consumer goods. For example, as already mentioned, the container may be a hinge-lid container having one or more hinged lids connected to a box housing the consumer goods. In one or more embodiments, the container may be a slide and shell container having an inner slide for housing the consumer goods mounted within an outer shell. Where the container is a slide and shell container, the outer shell or the inner slide may include one or more hinge lids. The container, inner frame, inner package, and outer wrapper may be formed from any suitable materials including, but not limited to, cardboard, paperboard, plastic, metal, or combinations thereof. The cardboard may have a weight of between about 100 grams per square meter and about 350 grams per square meter.

In one or more aspects of the present invention, the lid can be hingedly attached to the box along a lid hinge line between the lid rear wall and the box rear wall. The flap can be attached to an inner surface of the lid such that upon opening the lid, the flap is separated from the wrapper along the line of weakness and hinged to the remainder of the wrapper along a flap hinge line to form an access opening through which the consumer goods can be removed. The flap hinge line can be spaced from the lid hinge line. Preferably, the flap hinge line is spaced from the lid hinge line in at least the longitudinal direction of the container. That is, preferably, when the lid is in the closed position, the distance between the flap hinge line and the top wall of the container is less than the distance between the lid hinge line and the top wall of the container. Preferably, when the lid is in the closed position, the distance between the flap hinge line and the top wall of the container is at least two times less than the distance between the lid hinge line and the top wall of the container. The term "distance" is used above to refer to the shortest distance between any point on the top wall of the container and any point on a respective lid hinge line or flap hinge line. Preferably, the flap hinge line is located on the top wall of the inner package.

In one or more aspects of the present invention, the inner surface of the wrapper forms the entire inner surface of the flap.

Containers according to the invention may be in the shape of a rectangular parallelepiped, with right-angled longitudinal and right-angled transverse edges. Alternatively, the container may include one or more rounded longitudinal edges, rounded transverse edges, bevelled longitudinal edges, or bevelled transverse edges, or combinations thereof. For example, the container according to the invention may include, without limitation, one or more of the following features:

- one or two longitudinal rounded or bevelled edges on at least one of the front wall and the rear wall;
- one or two transverse rounded or bevelled edges on at least one of the front wall and the rear wall;
- one longitudinal rounded edge and one longitudinal bevelled edge on the front wall, or one transverse rounded edge and one transverse bevelled edge on the rear wall;
- one longitudinal rounded edge and one longitudinal bevelled edge on the front wall, and one transverse rounded edge and one transverse bevelled edge on the rear wall;
- one or two transverse rounded or bevelled edges on the front wall and one or two longitudinal rounded or bevelled edges on the front wall; and
- two longitudinal rounded or bevelled edges on a first side wall or two transverse rounded or bevelled edges on the second side wall.

Where the container includes one or more rounded edges, preferably the blanks forming the container include three, four, five, six, or seven scoring lines or creasing lines to form each rounded edge in the assembled container. The scoring lines or creasing lines may be either on the inside of the container or on the outside of the container. Preferably, the scoring lines or creasing lines are spaced from each other by between about 0.3 mm and 4 mm.

Preferably, the spacing of the creasing lines or scoring lines is a function of the thickness of the laminar blank. Preferably, the spacing between the creasing lines or scoring lines is between about 0.5 and about 4 times larger than the thickness of the laminar blank.

Where the container includes one or more bevelled edges, preferably the bevelled edge has a width of between about 1 mm and about 10 mm, preferably between about 2 mm and about 6 mm. In one or more embodiments, the container may include a double bevel formed by three parallel creasing or scoring lines that are spaced such that two distinct bevels are formed on the edge of the container. Where the container includes a bevelled edge, the bevel may be formed by two parallel creasing lines or scoring lines in the laminar blank from which the container is formed. The creasing lines or scoring lines may be arranged symmetrically to the edge between a first wall and a second wall. Alternatively, the creasing lines or scoring lines may be arranged asymmetrically to the edge between the first wall and the second wall, such that the bevel reaches further into the first wall of the container than into the second wall of the container.

Alternatively, the container may have a non-rectangular transverse cross section, for example, polygonal such as triangular or hexagonal, or oval, semi-oval, circular or semi-circular.

Containers according to the invention find particular application as packs for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes.

Through an appropriate choice of the dimensions thereof, containers according to the invention may be designed to hold different total numbers of smoking articles, or different arrangements of smoking articles. For example, through an appropriate choice of the dimensions thereof, containers according to the invention may be designed to hold a total of between ten and thirty smoking articles.

As well as housing a bundle of smoking articles, the container may further include other consumer goods, for example, matches, lighters, extinguishing means, breath-fresheners, or electronics. The other consumer goods may be attached to the outside of the container, contained within the container along with the smoking articles, in a separate compartment of the container, or combinations thereof.

The lid of the housing is hingedly attached to the box and is adapted to be manipulated between an open position and a closed position. In the open position, the consumer can access the consumer goods disposed within the housing. The lid is hingedly attached to the box along a hinge line that extends across a rear wall of the container. The term "hinge line" refers to a line about which the lid may be pivoted to open the container. A hinge line may be, for example, a fold line or a score line in the panel forming the rear wall of the housing. In one or more embodiments, the lid can include a front wall, a rear wall, and two sidewalls.

The container can also include an inner frame disposed within the box. The inner frame can be disposed between the inner package and the front wall of the box or within the inner package. When disposed within the inner package, the inner frame is positioned such that a front wall of the inner package is between the inner frame and the front wall of the box. The inner frame includes a front wall and a pair of opposed sidewalls. Preferably, the inner frame is U-shaped. The term "U-shaped" is used herein to refer to a shape that includes three parts, wherein the first part and the third part are parallel to each other and extend in the same direction perpendicular to the second part.

Preferably, the front wall of the inner frame is disposed such that the front wall of the inner package is between the front wall of the inner frame and the front wall of the box. Advantageously, an inner frame with a large surface area provided adjacent the front wall of the inner package increases the structural strength of the container.

Preferably, the inner frame includes a cut-out at the top of the front wall. The cut-out preferably substantially corresponds to the access opening, and is provided such that the consumer goods within the inner package may be more easily accessed. Where the inner frame includes a cut-out, the height of the inner frame is defined as the distance from the bottom of the inner frame to the cut-out.

The inner frame may include one or more reinforcing elements. Preferably, the one or more reinforcing elements includes an adhesive such that the adhesive reinforces the inner frame and inner package. Alternatively, the one or more reinforcing elements may include at least one layer of material, such as a similar cardboard to that utilized for manufacturing the inner frame, affixed to the inner frame. In this alternative, the at least one further layer of material is permanently affixed to the inner frame. Preferably, the at least one further layer is elongate. Where the inner frame is U-shaped, the at least one layer of material is preferably affixed to the outer surface of the front wall of the inner frame. Preferably, the at least one layer is affixed adjacent the top of the inner frame.

A carton that includes a lid and at least one sidewall can contain multiple containers as described herein.

The terms "front," "rear," "upper," "lower," "side," "top," "bottom," and other terms used to describe relative positions of the components of containers refer to the container in an upright position with the lid at the top end and the consumer goods accessible from the upper end at the front. The terms "left" and "right" can be used with reference to side walls of the container when the container is viewed from the front in its upright position.

The term "inner" refers to a portion or portions of a component of the assembled container that is disposed within the container when the lid is in the closed position. For example, the lid of the container includes an inner lid that is disposed within the container when the lid is in the closed position.

The term "inner surface" is used throughout the specification to refer to the surface of a component of the assembled container that is facing towards the interior of the container, for example towards the consumer goods, when the lid is in the closed position.

The term "outer" refers to a portion or portions of a component of the assembled container that is facing towards the exterior of the container when the lid is in the closed position.

The term "outer surface" is used throughout the specification to refer to the surface of a component of the assembled container that is facing towards the exterior of the container. For example, in one or more embodiments, the container includes an inner frame that includes an outer surface that is facing the outer housing of the container and an inner surface that is facing the inner package of the container.

All scientific and technical terms used herein have meanings commonly used in the art unless otherwise specified. The definitions provided herein are to facilitate understanding of certain terms used frequently herein.

Referring now to the drawings, in which some aspects of the present invention are illustrated:

Figure 1:
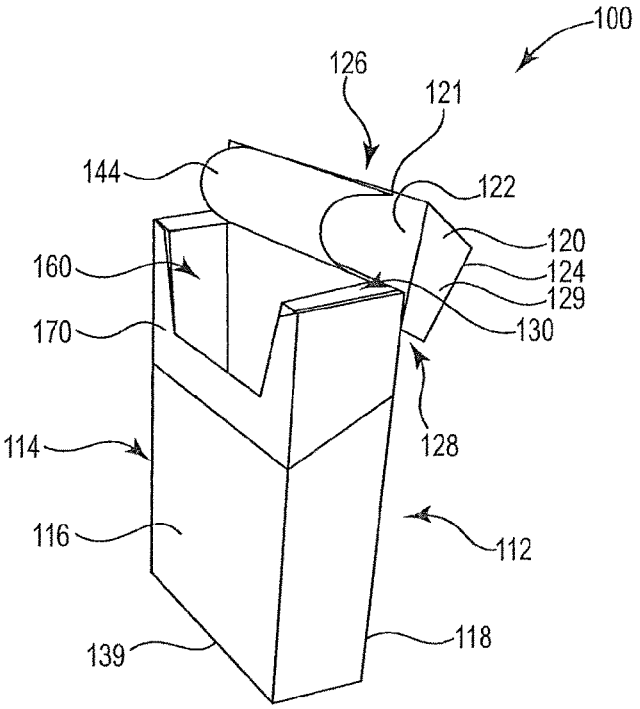
FIG. 1 is a schematic perspective view of an embodiment of a container in an open position, where the container includes a housing and an inner package disposed within the housing.
Figure 2:
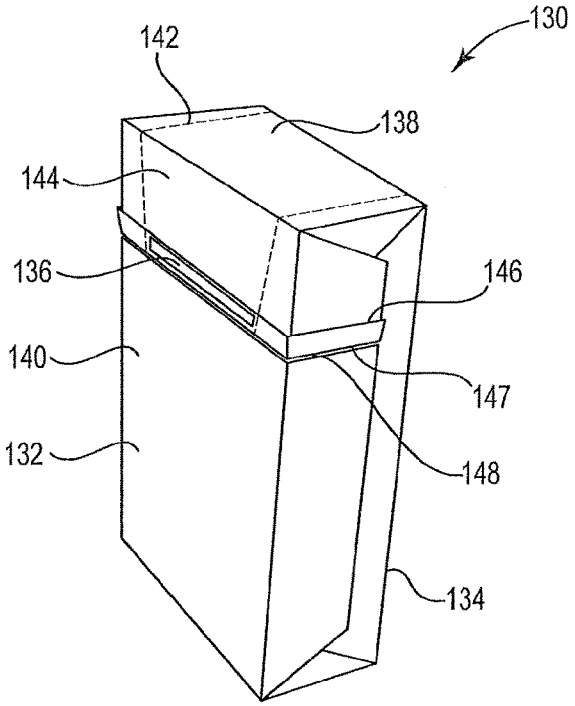
FIG. 2 is a schematic perspective view of the inner package of FIG. 1.

Referring to FIGS. 1-2, schematic perspective views of an embodiment of a container 100 for consumer goods and an inner package 130 disposed within a housing 112 of the container are depicted. The housing 112 includes a box 114 and a lid 120 hingedly attached to the box via a hinge line (not shown). The hinge line extends across a rear wall 118 of the box 114 of the container 110, and acts to allow the lid 120 to be moved from a closed position to an open position as shown in FIG. 1. The hinge line is disposed between a lid rear wall 128 and a box rear wall 118. The box 114 includes a front wall 116 and a rear wall 118. Further, the lid 120 includes a top wall 124, a front wall 126, the rear wall 128, and one or more sidewalls 129.

The inner package 130 at least partially defines an interior volume for housing consumer goods. In one or more embodiments, the container 100 can include consumer goods disposed within the inner package 130. The inner package 130 is made from a barrier material or materials to hermetically seal the consumer goods before the container is opened for the first time. The barrier material may be a metal foil or a plastic and metal laminate.

Referring to FIG. 2, a schematic perspective view of the inner package 130 of the container 100 of FIG. 1 is depicted. The inner package 130 includes a front wall 132 and a rear wall 134. The inner package 130 also includes a wrapper 140. The inner package 130 further includes a line of weakness 142 in the wrapper 140 that defines a flap 144. The flap 144 can be separated from the wrapper 140 of the inner package 130 along the line of weakness 142 to form an access opening 160 (FIG. 1) through which the consumer goods can be removed. The flap 144 is attached to the wrapper 140 along a hinge line (not shown). In one or more embodiments, the flap 144 is also attached to an inner surface 122 (FIG. 1) of the lid 120 such that upon opening the lid the flap is separated from the inner package 130 along the line of weakness 142 to at least partially uncover the access opening 160. In one or more embodiments, the flap 144 is attached to an inner lid front wall 121. In one or more embodiments, the flap 144 is only attached to the inner lid front wall 121 such that a gap is created between an inner surface of a top wall 124 and the rear wall 128 and the flap. When the lid is in the open position, the flap 144 forms an S-shape. Any suitable technique or combination of techniques can be utilized to attach the flap 144 to the inner surface 122 of the lid 120. In one or more embodiments, an adhesive 136 can be disposed on an outer surface 145 of the flap 144 that attaches the flap to the inner surface 122 of the lid 120.

The container 100 also includes an inner frame 170 disposed within the box 114. The inner frame 170 can include a reinforcing element (not shown) disposed between the inner frame and an inner surface of a front wall 116 of the box 114.

At least a portion of the rear wall 134 of the inner package 130 is permanently affixed to a corresponding portion of an inner surface (not shown) of the rear wall 118 of the box 114, thereby affixing the inner package to the inner surface of the rear wall of the box in a first region. Further, at least a portion of the front wall 132 of the inner package 130 is permanently affixed to a corresponding portion of an inner surface (not shown) of the front wall 116 of the box 114, thereby affixing the inner package to the inner surface of the front wall of the box in a second region. By permanently affixing at least a portion of the inner package 130 to one or both of the front wall 116 and the rear wall 118 of the box 114, the structural resilience of the inner package may be improved. The inner package 30 may be permanently affixed using, for example, hot melt adhesive, solvent based adhesive, water based adhesive, solvent-free adhesive, pressure-sensitive adhesive, conductive type sealing, and inductive type sealing. In a preferred embodiment, the inner package 30 is permanently attached to the box 14 using a hot melt adhesive.

Referring to FIG. 2, the wrapper 140 of the inner package 130 includes a first edge 146 and a second edge 148. The inner package 130 can be folded such that at least a portion of each of the first and second edges 146, 148 of the layer 140 transversely overlaps a front wall 132 of the inner package. As used herein, the phrase "transversely overlap" means that at least a portion of each of the first and second edges 146, 148 extends across the front wall 132 along a direction that is substantially transverse to a line connecting a top wall 138 with a bottom wall 139 of the inner package 130. The first edge 146 can be folded over upon itself along a fold line 147. Further, an adhesive 136 can be disposed on the wrapper 140 along at least a portion of the first edge 146 such that an inner surface of the flap 144 is attached to an inner surface 122 of the lid 120 of container 100. The flap 144 defined by the line of weakness 142 can, therefore, include at least a portion of the first edge 146 of wrapper 140 that is disposed on the front wall of the inner package 130.

In one or more embodiments, an envelope fold can be disposed on a bottom wall 139 of the inner package 130.

Figure 3:
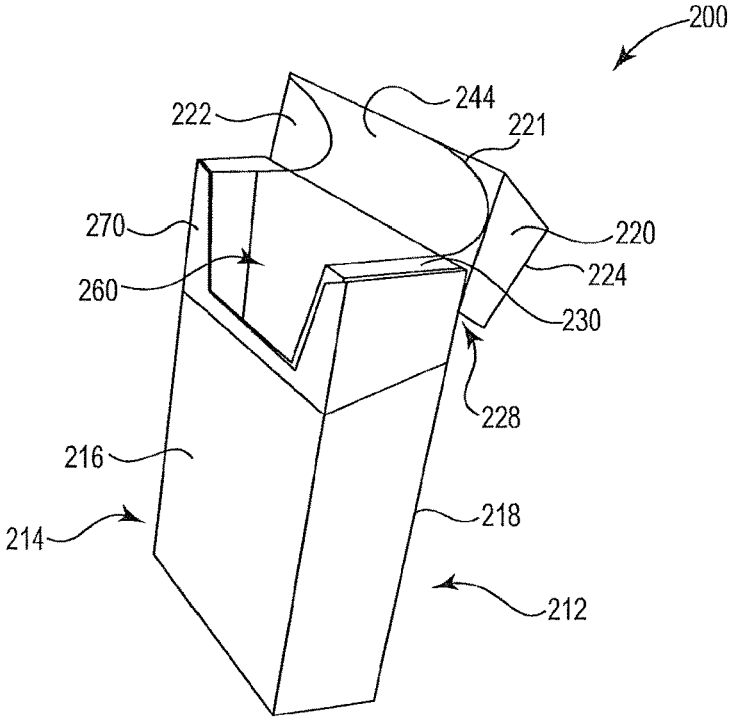
FIG. 3 is a schematic perspective view of another embodiment of a container in an open position, where the container includes a housing and an inner package disposed within the housing.
Figure 4:
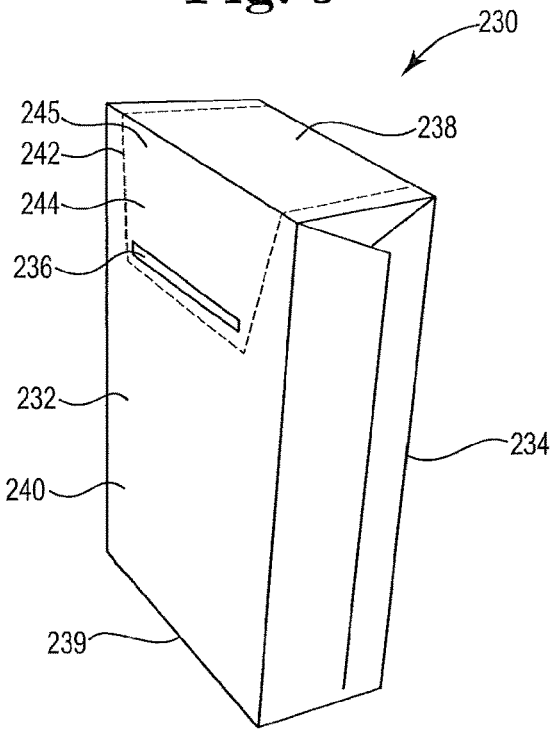
FIG. 4 is a schematic perspective view of the inner package of FIG. 3.

Referring to FIGS. 3-4, schematic perspective views of another embodiment of a container 200 and an inner package 230 disposed within a housing 212 of the container are depicted. All of the design considerations and possibilities regarding the container 100 of FIGS. 1-2 apply equally to the container 200 of FIGS. 3-4. The housing 212 includes a box 214 and a lid 220 attached to the box. The box 214 includes a front wall 216 and a rear wall 218. The inner package 230 can be disposed within the housing 212 and at least partially defines an interior for housing consumer goods. The container 200 can also include an inner frame 270 disposed within the box 214 between the front wall 216 of the box and the inner package 230.

As shown in FIG. 4, the line of weakness 242 defines a flap 244 that overlaps over a portion of a front wall 232 and the top wall 238 of the inner package 230. An adhesive 236 can be disposed on a portion of an outer surface 245 of the flap 244 to secure the flap to an inner surface 222 of lid 220 of the container 200. The flap 244 is attached to the inner surface 222 of the lid 220 such that upon opening the lid the flap is separated from the wrapper 240 along the line of weakness 242 and hinged to the remainder of the wrapper 240 along a flap hinge line (not shown) to form an access opening 260 through which consumer goods (not shown) can be removed from the container 200. In one or more embodiments, the flap 244 is attached to an inner lid front wall 221. In one or more embodiments, the flap 244 is only attached to the inner lid front wall 221 such that a gap is created between an inner surface of a top wall 224 and a rear wall 228 and the flap. When the lid is in the open position, the flap 244 forms an S-shape. In one or more embodiments, an envelope fold (not shown) can be disposed on a bottom wall 239 of the inner package 230.

Figure 5:
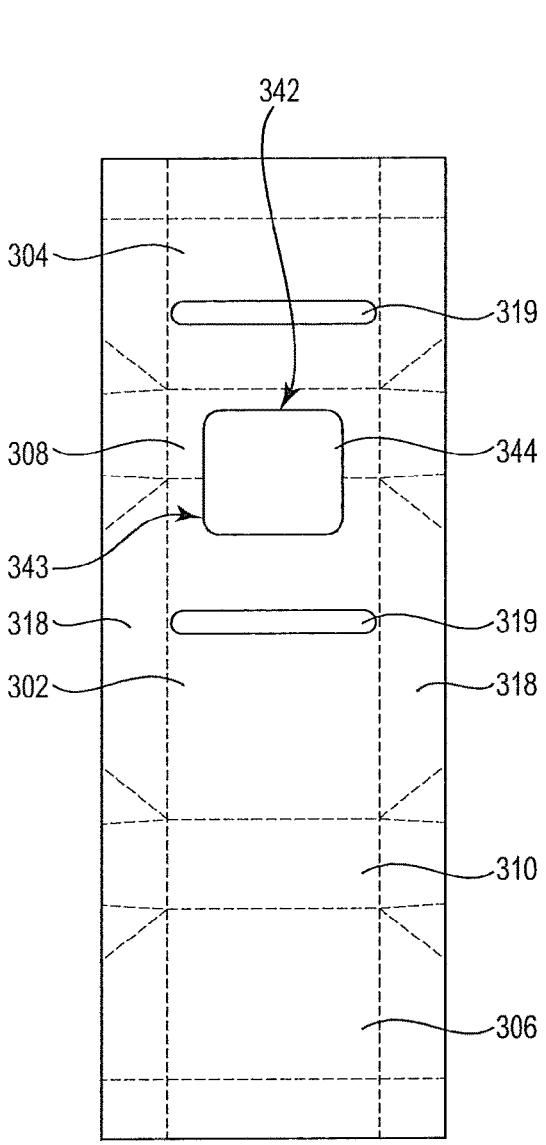
FIG. 5 is a schematic plan view of a blank used to form an inner package.
Figure 6:
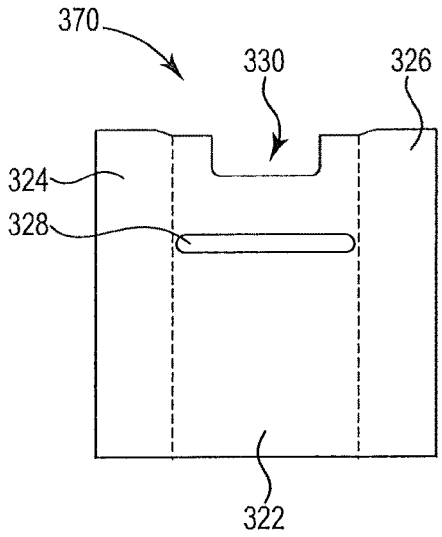
FIG. 6 is a schematic plan view of an inner frame.

Referring to FIGS. 5-6, schematic plan views of a pre-assembled wrapper 300 and an inner frame 370 are depicted. The pre-assembled wrapper 300 shown in FIG. 5 includes a front wall panel 302 that forms a front wall (for example, front wall 132 of inner package 130 of FIG. 2) of the inner package when assembled, two wall panels 304 and 306 that form a rear wall (for example, rear wall 134 of inner package 130 of FIG. 2) of the inner package when assembled, a top wall panel 308, and a bottom wall panel 310. The pre-assembled wrapper 300 also includes a plurality of side wall panels 318. As can be seen in FIG. 5, a line of weakness 343 disposed across a portion of the top wall panel 308 and the front wall panel 302 defines three sides of a flap 344. The fourth side 342 of the flap 344 acts as a hinge line between the flap 344 and the remainder of the wrapper. When assembled, this hinge line will be disposed on the top wall of the inner package.

The preassembled wrapper 300 can also include reinforcing elements 319. The reinforcing elements 319 can include any suitable reinforcing element described herein regarding the inner frame 170 of FIGS. 1-2.

FIG. 6 shows the pre-assembled inner frame 370. As described herein, the inner frame 370 includes a front wall 322 and two opposed side walls 324 and 326. An outer surface of the front wall 322 is provided with a reinforcing element 328. As described herein, a cut-out 330 is provided at the top of the front wall panel 322 of the inner frame. The cut-out 330 is provided to allow the consumer goods housed within the container to be accessed more easily. The cut-out 330 is provided such that it aligns with the access opening 60 (FIG. 1) provided in the inner package 30.

Figure 7:
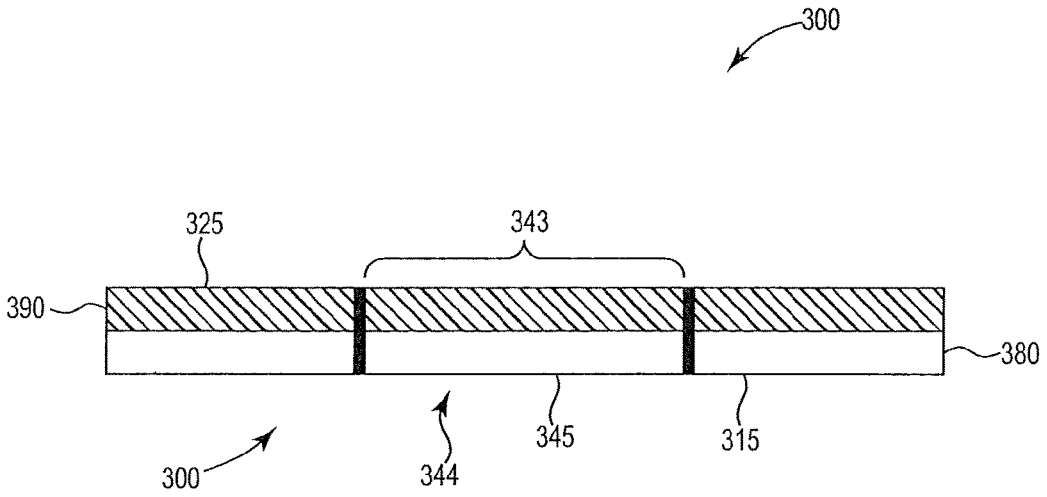
FIG. 7 is a cross-sectional view of the blank of FIG. 5.

FIG. 7 shows a cross sectional view of a portion of the wrapper 300 of FIG. 5. The wrapper 300 has a first layer 390 of metallized foil and a second layer 380 of paper. The wrapper 300 has an inner surface 315 and an outer surface 325. As can be seen, the inner surface of the wrapper 315 defines the entire inner surface 345 of the flap 344.

The dashed lines in the above described figures indicate fold lines.

The invention claimed is:

1. A container for consumer goods, comprising:

a housing comprising a box and a lid hingedly attached to the box along a lid hinge line, wherein the box comprises a front wall and a rear wall, and further wherein the lid is adapted to be manipulated between an open position and a closed position;

an inner package disposed within the housing and at least partially defining an interior volume for housing consumer goods, the inner package comprising a wrapper comprising a line of weakness that defines a flap in the wrapper;

wherein the flap is attached to an inner surface of the lid such that upon opening the lid the flap is separated from the wrapper along the line of weakness and hinged to the remainder of the wrapper along a flap hinge line to form an access opening through which the consumer goods can be removed; and wherein the flap hinge line is spaced from the lid hinge line, and wherein the entire inner surface of the flap is provided by the inner surface of the wrapper.

2. The container of claim 1, wherein the wrapper is folded along one or more fold lines to form the inner package, wherein the wrapper comprises a first edge and a second edge, wherein the wrapper is folded such that at least a portion of each of the first and second edges of the wrapper transversely overlaps a front wall of the inner package, and further wherein the flap comprises at least a portion of the first edge of the wrapper that is disposed on the front wall of the inner package.

3. The container of claim 2, wherein the flap is folded over along a fold line such that an inner surface of the flap is attached to the inner surface of the lid.

4. The container of claim 1, wherein when the lid is in the closed position, the distance between the flap hinge line and the top wall of the container is at least two times less than the distance between the lid hinge line and the top wall of the container.

5. The container of claim 1, wherein the flap hinge line is located on the top wall of the inner package.

6. The container of claim 1, wherein the flap is attached to the inner surface of the lid by a permanent adhesive.

7. The container of claim 1, wherein at least a portion of an outer surface of the inner package is permanently affixed to a corresponding portion of an inner surface of the rear wall of the box.

8. The container of claim 1, wherein at least a portion of the outer surface of the inner package is permanently affixed to a corresponding portion of an inner surface of the front wall of the box.

9. The container of claim 1, further comprising an inner frame disposed within the box, wherein the inner frame comprises a front wall and a pair of opposed side walls.

10. The container of claim 9, wherein the inner frame is disposed between the front wall of the box and the inner package.

11. The container of claim 1, wherein the flap takes an S-shape when the lid is in the open position.

12. The container of claim 1, wherein the flap is attached to an inner lid front wall of the lid.

13. The container of claim 1, wherein the inner package comprises a paper material.

14. The container of claim 1, further comprising the consumer goods, wherein the consumer goods are housed in the interior volume defined by the inner package.

15. The container of claim 14, wherein the consumer goods are smoking articles.

16. The container of claim 1, wherein the wrapper comprises a first layer and a second layer.

17. The container of claim 16, wherein the first layer comprises a metallized foil and the second layer comprises paper.

18. The container of claim 1, wherein the flap comprises three sides that separate the flap from the wrapper and a fourth side that forms the flap hinge line.

19. The container of claim 1, wherein between about 5 percent and about 25 percent of material of the wrapper remains along the line of weakness after the line has been formed.

20. The container of claim 1, wherein the line of weakness is discontinuous.

* * * * *